US012055136B2

(12) United States Patent
Van Acker

(10) Patent No.: US 12,055,136 B2
(45) Date of Patent: Aug. 6, 2024

(54) COMPRESSOR PROVIDED WITH AN ELECTRONIC PRESSURE SWITCH AND METHOD OF REGULATING THE PRESSURE WITHIN SUCH A COMPRESSOR

(71) Applicant: Abac Aria Compressa S.p.A., Robassomero TO (IT)

(72) Inventor: Maarten Van Acker, Wilrijk (BE)

(73) Assignee: ABAC ARIA COMPRESSA S.P.A., Robassomero To (IT)

( * ) Notice: Subject to any disclaimer, the term of this patent is extended or adjusted under 35 U.S.C. 154(b) by 344 days.

(21) Appl. No.: 15/952,341

(22) Filed: Apr. 13, 2018

(65) Prior Publication Data

US 2018/0306188 A1 Oct. 25, 2018

(30) Foreign Application Priority Data

Apr. 19, 2017 (IT) ..... 102017000043015

(51) Int. Cl.

*F04B 49/02* (2006.01)
*F04B 35/04* (2006.01)
*F04B 49/06* (2006.01)

(52) U.S. Cl.

CPC ..... *F04B 49/065* (2013.01); *F04B 35/04* (2013.01); *F04B 49/022* (2013.01); *F04B 2203/0201* (2013.01); *F04B 2205/05* (2013.01)

(58) Field of Classification Search

CPC ..... F04B 17/03; F04B 35/04; F04B 37/14; F04B 49/02; F04B 49/022; F04B 49/06; F04B 49/065; F04B 49/10; F04B 2203/0201; F04B 2205/05; F04B 2201/1203; F04B 49/08; F04B 35/00; F04B 35/06; F04B 17/00; F04B 23/00; F04B 23/02; F04B 23/025; F04B 23/028;
(Continued)

(56) References Cited

U.S. PATENT DOCUMENTS 4,975,024 A * 12/1990 Heckel ..... F04D 27/0284 417/20
6,017,192 A 1/2000 Clack et al.
(Continued)

FOREIGN PATENT DOCUMENTS

CN 106438312 A * 2/2017 ..... F04B 49/06
EP 3564442 B1 * 3/2022 ..... B61L 5/00
(Continued)

OTHER PUBLICATIONS

Italian Search Report in corresponding Italian Application No. IT 201700043015 dated Dec. 18, 2017.

*Primary Examiner* — Devon C Kramer
*Assistant Examiner* — Chirag Jariwala
(74) *Attorney, Agent, or Firm* — BACON&THOMAS,PLLC

(57) ABSTRACT

A compressor provided with a compressor element, a motor configured to drive said compressor element and an electronic pressure switch. The electronic pressure switch includes a pressure sensor; a current sensor; a microprocessor unit including a first input port and a second input port; a first communication unit; and a second communication unit. The electronic pressure switch includes a housing. The microprocessor unit, the pressure sensor, the current sensor, the first communication unit and the second communication unit are integrated in said housing.

14 Claims, 4 Drawing Sheets

(58) Field of Classification Search
CPC ..... F04B 2203/02401; F04B 2207/703; F04C 14/06; F04C 14/28; F04C 28/06; F04C 28/28; F04C 2270/07; F04C 2270/075; F04C 2270/08; F04C 2270/085; F04C 2270/18; F04C 2270/185; F04C 2270/44; F04C 2240/40; F04C 2270/90; H01H 35/24–405
USPC ... 417/44.1, 45, 44.2, 44.4, 44.11, 307, 308, 417/410.1, 423.1, 415, 410.3–410.5, 18
See application file for complete search history.

(56) References Cited

U.S. PATENT DOCUMENTS 8,116,911 B2 * 2/2012 Bailey ..... F25B 49/02 700/276
8,467,950 B1 * 6/2013 Pfefferl ..... B60T 17/02 701/100
2003/0058128 A1 * 3/2003 Crunk ..... G08C 17/02 340/870.02
2004/0009075 A1 * 1/2004 Meza ..... F04B 49/065 417/32
2004/0191073 A1 * 9/2004 Iimura ..... F04B 49/065 417/44.2
2005/0235660 A1 10/2005 Pham
2006/0110258 A1 * 5/2006 Iimura ..... F04B 49/08 417/18
2007/0114162 A1 * 5/2007 Stiles ..... F04D 15/0066 210/137
2009/0324427 A1 * 12/2009 Tolbert, Jr. ..... F04B 39/0207 417/13
2010/0293397 A1 11/2010 Pham et al.
2013/0071258 A1 * 3/2013 Enomoto ..... F04B 49/10 417/44.1
2014/0029178 A1 1/2014 Trudeau, Jr. et al.
2015/0056083 A1 * 2/2015 Lumsden ..... F04B 35/04 417/45
2015/0086382 A1 * 3/2015 Tamminen ..... F24D 19/1012 417/29
2016/0003691 A1 1/2016 Arunasalam et al.
2018/0156217 A1 * 6/2018 Sakima ..... F04B 49/106
2018/0266422 A1 * 9/2018 Sun ..... F04C 18/16
2018/0374664 A1 * 12/2018 Garcia ..... H01H 35/2678

FOREIGN PATENT DOCUMENTS

JP H08261160 A * 10/1996 ..... F04B 49/10
JP 2006054941 A * 2/2006 ..... F04B 49/06
JP 5276951 B2 * 8/2013 ..... F04B 39/00
WO WO-2009028466 A1 * 3/2009 ..... F04B 41/02

* cited by examiner

COMPRESSOR PROVIDED WITH AN ELECTRONIC PRESSURE SWITCH AND METHOD OF REGULATING THE PRESSURE WITHIN SUCH A COMPRESSOR

BACKGROUND OF THE INVENTION

This invention relates to compressor provided with a compressor element, a motor configured to drive said compressor element and an electronic pressure switch, said electronic pressure switch comprising: a pressure sensor for sensing a pressure signal at a compressed gas outlet of the compressor; a current sensor for sensing a current signal of the motor driving the compressor element; a microprocessor unit comprising a first input port connected to said pressure sensor for receiving the signal based on the pressure measurement and a second input port connected to said current sensor for receiving the current signal based on the current measurement; a first communication unit for connecting the electronic pressure switch with a drive of the motor; and a second communication unit for connecting the electronic pressure switch with a blow-off valve provided at the compressed gas outlet.

An electronic control of different system parameters within a compressor is a desired feature for users of such compressors.

Many different technologies can be found throughout the industry, like for example the technology described within U.S. Pat. No. 6,017,192 A, having Clack Richard and Laird David Wallace as inventors.

The document describes a system in which every compressor comprises a controller monitoring its parameters and shutting the compressor down when a faulty condition is encountered. Each controller further communicates with a rack controller which is further connected to different sensors, said rack controller receiving alarm signals from the compressor controller whenever a faulty condition is encountered.

Since the technology described therein is adapted for circuits comprising multiple compressors, such a type of system control would not be ideal for single compressors, smaller types of compressor or single user compressors because the complete system would be too complex in terms of processing, cost and implementation.

Another drawback that can be associated with the above identified system would be the difficult and time consuming servicing process, which would potentially lead to long time intervals in which the compressor would not function and therefore, to big cost losses for the user of such systems.

SUMMARY OF THE INVENTION

Taking the above drawbacks into account it is an object of the present invention to provide a compressor with an integrated solution for an electronic pressure switch that would be easy to use, easy to mount and easy to replace in case of failure.

Another object of the present invention is to provide a cost effective solution for any type of compressors: single compressor systems, single user compressors or small capacity compressors as well as for more complex systems comprising a plurality of compressors.

Another object of the present invention is to provide an electronic pressure switch that would be implementable in new compressor units or in existing ones just as easy. Furthermore such an electronic pressure switch would be very compact and would not require additional wiring or piping for its implementation.

The present invention solves at least one of the above and/or other problems by providing a compressor provided with a compressor element, a motor configured to drive said compressor element and an electronic pressure switch, said electronic pressure switch comprising:

- a pressure sensor for sensing a pressure signal at a compressed gas outlet of the compressor;
- a current sensor for sensing a current signal of the motor driving the compressor element;
- a microprocessor unit comprising a first input port connected to said pressure sensor for receiving the signal based on the pressure measurement and a second input port connected to said current sensor for receiving the current signal based on the current measurement;
- a first communication unit for connecting the electronic pressure switch with a drive of the motor;
- a second communication unit for connecting the electronic pressure switch with a blow-off valve provided at the compressed gas outlet;

whereby the electronic pressure switch further comprises a housing, and in that the microprocessor unit, the pressure sensor, the current sensor, the first communication unit and the second communication unit are integrated in said housing.

Because the microprocessor unit, the pressure sensor, the current sensor, the first communication unit and the second communication unit are integrated within the housing, the pressure switch according to the present invention is very compact and easy to manufacture.

Because of its layout, the electronic pressure switch according to the present invention is an integrated device, comprising all the needed components for monitoring, controlling, communicating and protecting the compressor.

Accordingly, the electronic pressure switch of the present invention is much faster in performing the measurements, the calculations and control of different components part of the compressor 1.

Furthermore, such a layout facilitates an easy servicing procedure and also an easy implementation in existing compressors. The electronic pressure switch needing only to be mounted at a compressed gas outlet and be connected to the motor driving such compressor and to the blow-off valve by using the first communication unit and the second communication unit.

Such an integrated device allowing a less complex installation, since it already comprises a pressure sensor and a current sensor, there is no need for additional sensors to be mounted within the compressor and no additional communicating paths or wiring to be introduced to potentially existing sensors.

Moreover, the compressor would not need an extra starter module or an extra communication module for controlling the motor driving the compressor or the blow off valve.

The pressure switch according to the present invention would only need to be mounted onto the compressor, allowing the user to benefit from its capabilities in a very easy and fast manner.

Furthermore, because the electronic pressure switch comprises a pressure sensor and a current sensor therein, the frequency with which the measurements are done is very high when compared to the existing methods. The only limit being the technical limitation of the microprocessor, making the electronic pressure sensor according to the present invention a very accurate measurement unit, providing a safe control for both: the motor and the compressor. Furthermore, because the pressure sensor and the current sensor are comprised within said housing, the risk of encountering measurement errors or delays due to a communication path that would be too long or a faulty cable is eliminated.

Moreover, because the pressure sensor and the current sensor are comprised within said housing and chosen upon the design of the pressure sensor, there is no risk of incompatibility between these components.

A compressor provided with an electronic pressure switch according to the present invention being a fully integrated, compact and efficient solution for monitoring and controlling a compressor. The present invention is further directed to a method for regulating the pressure within a compressor, the method comprising the following steps:

connecting an electronic pressure switch on a compressed gas outlet;

connecting a first communication unit of the electronic pressure switch with a drive of a motor driving the compressor;

measuring the pressure at the outlet of the compressor;

measuring the current of the motor;

sending a signal based on the pressure measurement and a signal based on the current measurement to a microprocessor unit part of the electronic pressure switch;

whereby the microprocessor unit is:

converting the signal into a pressure value if the signal received based on the pressure measurement is not a digital signal, is further comparing the pressure value with an upper pressure limit and if said pressure value is higher than the upper pressure limit, said microprocessor unit is sending an electronic signal through said first communication unit stopping the motor; and/or converting the signal into a current value if the signal received based on the current measurement is not a digital signal, is further comparing the current value with an upper current limit and if said current value is higher than the upper current limit, said microprocessor unit is sending an electronic signal through said first communication unit stopping the motor.

Because the microprocessor unit is performing such comparisons, the motor is protected against experiencing an overcurrent and also against high and potentially damaging pressures.

Accordingly, the lifespan of both the motor and the compressor are increased through a very simple to implement solution.

In the context of the present invention it should be understood that the benefits presented with respect to the compressor also apply for the method for regulating the pressure within a compressor and vice-versa.

The present invention is further directed to a vacuum pump provided with a vacuum element, a motor configured to drive said vacuum element and an electronic pressure switch, said electronic pressure switch comprising:

a pressure sensor for sensing a pressure signal at a vacuum outlet of the vacuum pump;

a current sensor for sensing a current signal of the motor driving the vacuum element;

a microprocessor unit comprising a first input port connected to said pressure sensor for receiving the signal based on the pressure measurement and a second input port connected to said current sensor for receiving the current signal based on the current measurement;

a first communication unit for connecting the electronic pressure switch with a drive of the motor;

a second communication unit for connecting the electronic pressure switch with a blow-off valve provided at the compressed gas outlet;

whereby the electronic pressure switch further comprises a housing, and in that the microprocessor unit, the pressure sensor, the current sensor, the first communication unit and the second communication unit are integrated in said housing.

Furthermore, it should be understood that the benefits presented with respect to the compressor and the method for regulating the pressure within a compressor also apply for the vacuum pump.

BRIEF DESCRIPTION OF THE DRAWINGS

With the intention of better showing the characteristics of the invention, some preferred configurations according to the present invention are described hereinafter by way of an example, without any limiting nature, with reference to the accompanying drawings, wherein.

DETAILED DESCRIPTION OF THE INVENTION

Figure 1:
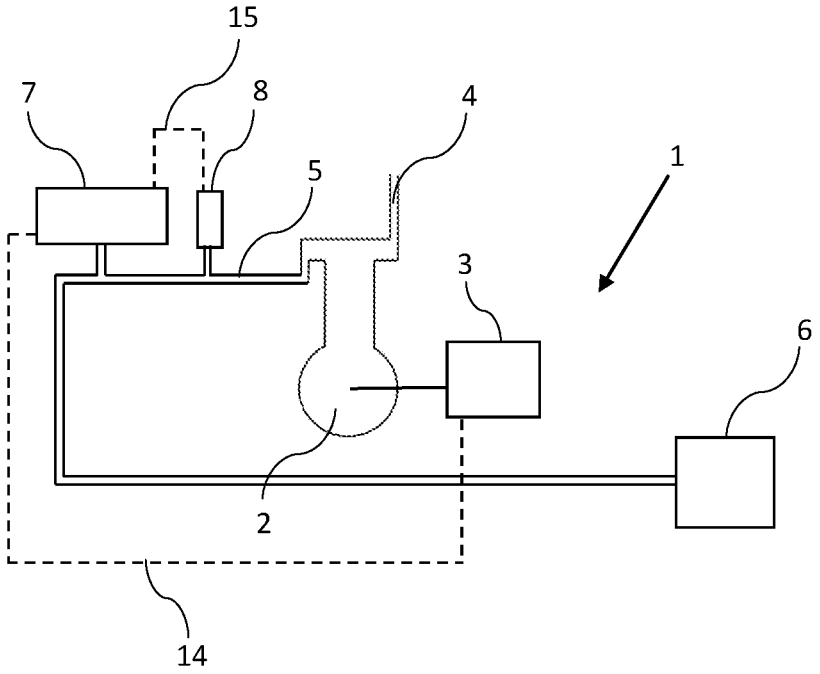
FIG. 1 schematically represents a compressor system according to the present invention.

FIG. 1 illustrates a compressor 1 comprising a compressor element 2 and a motor 3 configured to drive said compressor element 2.

The compressor element 2 having a process gas inlet 4 and a compressed gas outlet 5, through which compressed gas is provided to a user network 6.

The compressor 1 further comprises an electronic pressure switch 7 connected on the compressed gas outlet 5 and a blow-off valve 8 provided on the compressed gas outlet 5.

The blow-off valve 8 being used for eliminating the air trapped within the compressor element 2 whenever the motor is stopped. By incorporating such a blow-off valve 8, the compressor element 2 is prepared for a next restart of the motor 3.

Since the compressor element 2 is not started under load the compressor 1 is being protected against potentially damaging torque forces, and the needed pressure value at the compressed gas outlet 5 is reached faster.

In the context of the present invention, the compressor 1 should be understood as the complete compressor installation, including the compressor element 2, all the typical connection pipes and valves, the housing of the compressor 1 and possibly the motor 3 driving the compressor element 2.

In the context of the present invention, the compressor element 2 should be understood as the compressor element casing in which the compression process takes place by means of a rotor or through a reciprocating movement.

In the context of the present invention, said compressor element 2 can be selected from a group comprising: a screw, a toothed, a claw, a scroll, a rotary vane, a centrifugal, a piston, etc.

Figure 3:
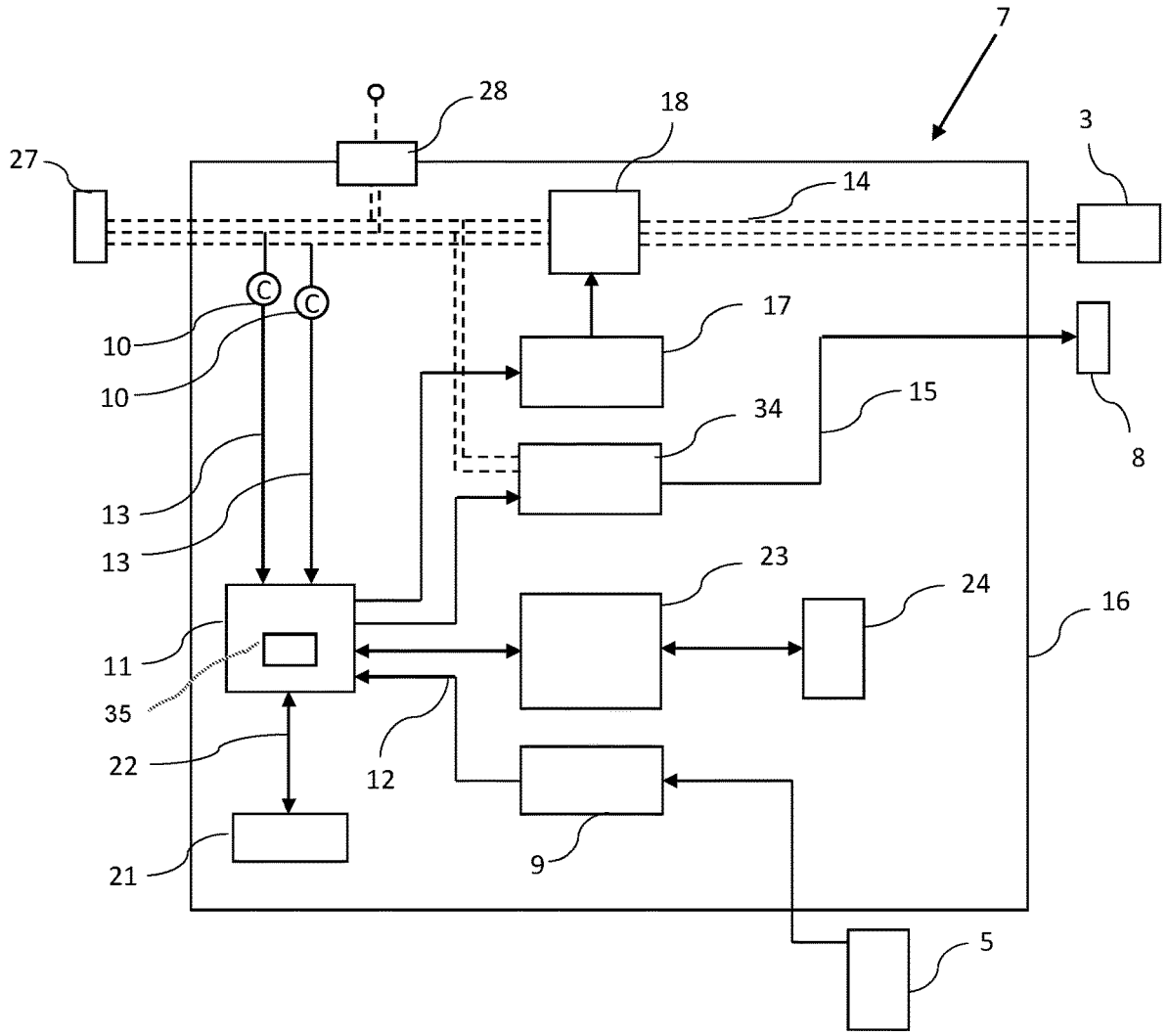
FIG. 3 schematically represents a layout of the pressure switch according to the present invention.

In FIG. 3, an example of a layout of the electronic pressure switch 7 can be found, said electronic pressure switch 7 comprising a pressure sensor 9 for sensing a pressure signal at a compressed gas outlet 5 of the compressor 1 and a current sensor 10 for sensing a current signal of the motor 3 driving the compressor element 2.

In the context of the present invention, sensing the current signal of the motor 3 driving the compressor element 2 should be understood as measuring the intensity of the electric current running through the drive coil of said motor 3.

Further, measuring the intensity of the electric current running through the drive coil should be understood as measuring the magnitude of the electric current as measured by the flow of electric charge crossing the drive coil per unit of time.

In the context of the present invention, it should be understood that said compressor 1 can comprise either a fixed speed motor or a variable speed motor.

Returning to FIG. 3, the electronic pressure switch 7 further comprises a microprocessor unit 11 comprising a first input port 12 connected to said pressure sensor 9 for receiving the signal based on the pressure measurement and a second input port 13 connected to said current sensor 10 for receiving the current signal based on the current measurement.

The electronic pressure switch 7 further comprises a first communication unit 14 for connecting the electronic pressure switch 7 with a drive of the motor 3 and a second communication unit 15 for connecting the electronic pressure switch 7 with the blow-off valve 8 provided at the compressed gas outlet 5.

Preferably, the electronic pressure switch 7 further comprises a housing 16, wherein the microprocessor unit 11, the pressure sensor 9, the current sensor 10, the first communication unit 14 and the second communication unit 15 are integrated.

Because the pressure sensor 9 and the current sensor 10 are comprised within the housing 16, the electronic pressure switch 7 is very compact and easy to implement, not needing additional wiring or connection means to existing components of the compressor 1, and of course not needing additional sensors to be mounted within said compressor 1. Such a layout has the benefit that the servicing can be done very fast and easy.

In the context of the present invention, integrated should be understood as being either enclosed within the housing 16, therefore completely covered by said housing 16, or being provided onto said housing 16 and being accessible from inside and outside the housing 16.

Preferably, said electronic pressure switch 7 comprises a single electronic assembly, whereby the communication between the different components or block of components is done at the level of a PCB (Printed Circuit Board). The electronic assembly comprising the microprocessor unit 11 and all the components integrated therein, reducing even more the complexity of the manufacturing process, excluding the need of additional wires for communicating with different components and making the electronic pressure sensor 7 according to the present invention even more compact.

Because the communication is done at the level of the PCB, the risk of delays or possible interference on connecting cables is eliminated.

In the context of the present invention, a port should be understood as a specific place whereby a physical connection between two modules or devices is done, usually being either a pin of a microprocessor connected through an electric connection with another module or device, or a socked and a plug type of connection.

In an embodiment of the present invention, said first communication unit 14 being unidirectional or bidirectional.

In an embodiment according to the present invention, the electronic pressure switch 7 further comprises a motor starter (not shown), facilitating an even more complete control of the compressor 1.

Known devices would typically adopt a much more different approach than of the electronic pressure switch 7: either a distributed or a semi-distributed system.

The distributed system typically comprising components such as: a controller with screen and buttons, one or more sensors connected to the motor, a motor starter, one or more sensors for sensing one or more system parameters, whereby the components are mounted at their respective location within the compressor. Such system further comprising the respective wiring for the communication between the different components and a housing for each component.

The semi-distributed system typically combining some components within one housing but would not contain the respective current sensor or pressure sensor within said housing and would not contain a motor starter.

Such typically used systems being more complex since they require a more complex wiring and therefore a more complex installation and servicing procedure and are generally more complex to use because they typically need at least one extra module to complete the compressor controlling.

In the example shown in FIG. 3, the first communication unit 14 is unidirectional, the microprocessor unit 11 is receiving a signal based on a measurement of the current through the current sensor 10 and sends a command signal through the relay driver circuit 17, the electric relay 18 and the first communication unit 14 towards the motor 3, preferably controlling its driving capabilities.

Said relay driver circuit 17 converting the command received from the microprocessor unit 11 into an electrical signal recognized by the electric relay 18.

In the context of the present invention the driver circuit 17 and the electric relay 18 should be seen as components adapting the signal received from a low power circuit comprising the microprocessor 11 to a high power circuit comprising the motor 3.

However, it should not be excluded that the current sensor 10, the relay driver circuit 17 and the electric relay 18 can be realized as one module.

In the context of the present invention an electric relay 18 should be understood as an electrically operated switch.

Figure 2:
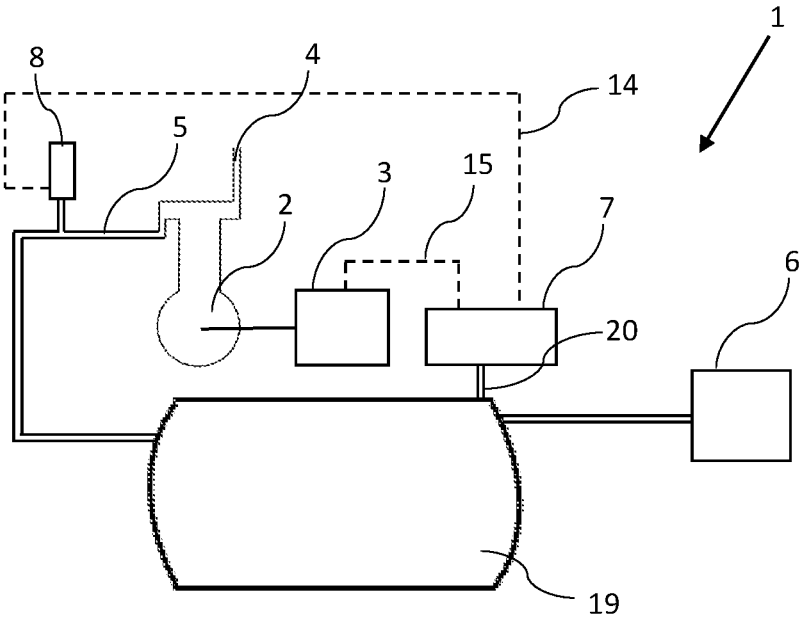
FIG. 2 schematically represents another compressor system according to the present invention.

In another embodiment according to the present invention and as illustrated in FIG. 2, the compressor 1 further comprises a pressure vessel 19. For such an example, the electronic pressure switch 7 is preferably adapted to be provided on a vessel outlet 20 of said pressure vessel 19.

By providing the electronic pressure switch 7 at the outlet of the pressure vessel 19, a more accurate measurement of the pressure value reaching the user network 6 can be performed. In this way, any short term fluctuations of pressure generated by the functioning of the compressor element 2 are excluded. Because of this and the very short response time of the electronic pressure switch 7, the pressure value within the pressure vessel 19 can be maintained at approximately the pressure value desired at the user network 6, meeting the demand and increasing the efficiency of the compressor 1.

Because the electronic pressure switch 7 is mounted on the outlet of the pressure vessel 19, the motor 3 can be directly controlled in order to meet the demand at the user's network 6. Consequently, a more stable motor functioning is achieved and at the same time a more stable pressure of the compressed gas reaching the user's network.

Such a layout is beneficial to the lifetime of the motor 3, and better for applications in which the compressor 1 is connected in a network.

If the compression process takes place through a reciprocating movement, for achieving a more accurate measurement, the electronic pressure switch 7 is preferably mounted on the vessel outlet 20, otherwise the electronic pressure switch 7 can either be mounted on the compressed gas outlet 5 or on the vessel outlet 20.

Existing systems without such an electronic pressure switch 7 would typically maintain the pressure value within the pressure vessel 19 at a value higher than the pressure value desired at the user network 6 in order to meet the demand. Accordingly, by using an electronic pressure switch 7 according to the present invention, the compressor would function in a more efficient manner, since the pressure value within the pressure vessel 19 can be maintained at approximately the same pressure value desired by the user at the user's network.

In another embodiment according to the present invention, the electronic pressure switch 7 further comprises a wireless communication interface 21 further comprising a wireless transceiver selected from a group comprising: a Bluetooth, an RF (Radio Frequency), Wi-Fi (wireless fidelity), and Infrared.

Consequently, the electronic pressure switch 7 according to the present invention is capable of sending data such as different measurements concerning the compressor like for example, and not limiting thereto: the measured pressure, the measured current, other measured values, compressor status analysis, compressor condition monitoring, service status and updates, and receiving data such as for example and not limiting thereto: the pressure required at the user's network 6, compressor commands, updates concerning the date when the service is due.

Because the electronic pressure switch 7 according to the present invention combines electromechanical components or block of components such as the pressure sensor 9, the current sensor 10 and the motor starter with components or block of components that are typically electronic such as the microprocessor unit 11 and the wireless communication interface 21 within the same housing 16, the control of the compressor 1 is done in a faster and more reliable way when compared to the existing solutions.

Preferably but not limiting thereto, the wireless communication interface 21 comprises a Bluetooth transceiver. By including such a Bluetooth transceiver, the manufacturing costs for an electronic pressure switch 7 according to the present invention are maintained low. At the same time, the provided solution is a compact remotely accessible low power consumption electronic pressure switch 1, with an easy access while in the proximity of the compressor 1.

A user of such an electronic pressure switch 7 being able to connect to the compressor 1 directly or through said wireless communication interface 21 communicating with an external device (not shown). The user connecting to the compressor 1 through said external device.

In the context of the present invention said external device should be understood as any type of electronic device having communicating and possibly display and computing capabilities, such as selected from a group comprising: a computer, a smartphone, a tablet, a PDA (Personal Digital Assistant), the cloud, or others.

A user of such an electronic pressure switch 7 after creating such a connection through the wireless communication interface 21, being capable of changing the functioning of the compressor 1 such as through a start/stop command, to change the speed of the motor 3 if said motor 3 is a variable speed motor, to change the requirements at the user's network 6 such as the pressure of the gas or the required flow of gas, to change the intervals at which a service procedure should be performed or any other actions involving a message shown on the screen 24 or involving the functioning of the compressor 1.

Preferably, by remotely connecting to the compressor 1, a user of a compressor 1 according to the present invention is able to remotely control the pressure value at the vessel outlet 20 and the current value at which the driving capabilities of the motor 3 are being controlled.

Furthermore, the user can extract or create graphs with the functioning pattern of the compressor 1, he can for example evaluate the electricity costs and identify any potential issues that might appear within the network such as a faulty power supply circuit or faulty component within the compressor 1. He can also retrieve information regarding how many start/stop actions the compressor 1 has been subjected to and possibly the moment in time when these actions happened, but also the remaining time interval until a service procedure is due.

The user can further retrieve information such as the upper pressure limit of the compressor 1, and also the upper current limit and the types of components mounted within the compressor 1.

In the context of the present invention, a wireless RF transceiver should be understood as a transceiver emitting and receiving an electric signal of an electromagnetic wave having a frequency that lies in the range from approximately 3 kHz (kilohertz) to approximately 300 GHz (Gigahertz).

Further, a wireless Wi-Fi transceiver should be understood as a transceiver functioning according to the IEEE 802.11 standard and capable of communicating through a wireless local area network.

Whereas a wireless infrared transceiver should be understood as a transceiver emitting and receiving an electric signal of an electromagnetic wave having a frequency that lies in the range from approximately 300 GHz (Gigahertz) to approximately 430 THz (Terahertz).

For an easy remote control, said microprocessor unit 11 comprises a third input port 22 connected to said wireless transceiver.

Said third input port 22 preferably being a bidirectional communication path.

In another embodiment according to the present invention, said pressure sensor 9 can be any type of pressure sensor such as for example and not limiting to: a capacitive, an electromagnetic, an electronic pressure sensor, a piezoelectric or an optical pressure sensor.

In yet another embodiment according to the present invention, the pressure sensor 9 is an air pressure transducer providing a value of the pressure sensed at the compressed gas outlet 5 or at the vessel outlet 20.

Further, said current sensor 10 can be any type of current sensor such as for example and not limiting to: a Hall effect sensor, a transformer or current clamp meter, a fluxgate transformer type of sensor, a resistor type of sensor, a fiber optic current sensor, a Rogowski coil, etc.

Figure 4:
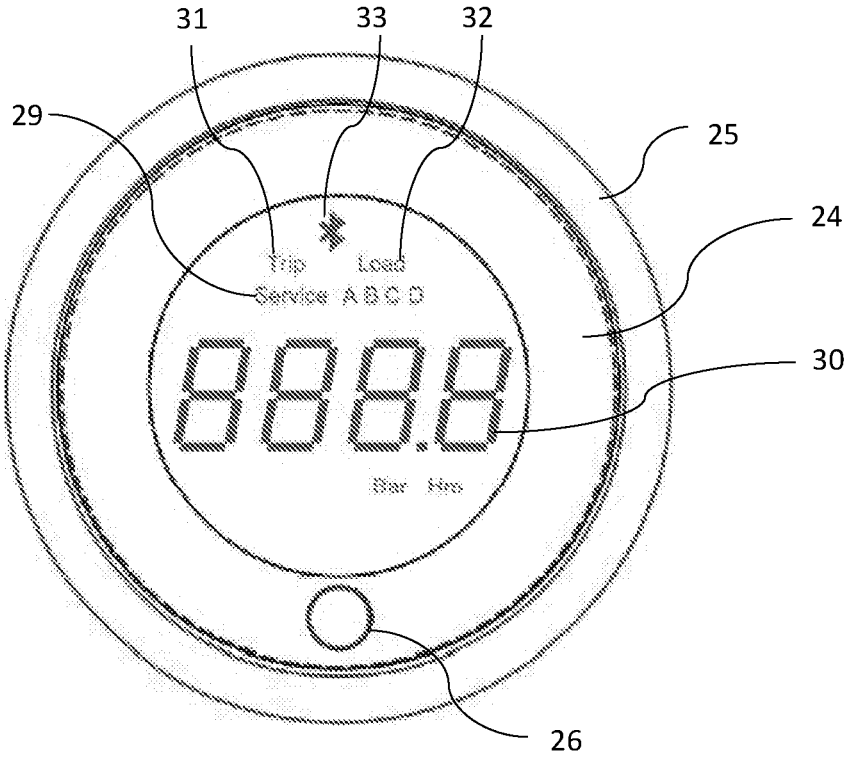
FIG. 4 schematically represents a front view of the pressure switch according to the present invention.

For further facilitating the communication between the user and the electronic pressure switch 7, said electronic pressure switch 7 further comprises a user interface 23 further comprising a screen 24, as can be seen in FIG. 4.

Said screen 24 being of any type such as for example: a LCD (Liquid Crystal Display), a capacitive, a resistive or any other type.

Preferably but not limiting thereto, the screen 24 is an LCD touch screen.

It should be however understood that other types of screens can be also used, being or not touch screens.

Said housing 16 can further comprise a control dial 25, said control dial 25 being either a manual actuated control dial or an electronic control dial.

Preferably but not limiting thereto, said control dial 25 allowing for both: a manual and an electronic actuation.

In case the user is changing the settings manually, the screen 24 further comprises a push button 26 for facilitating the selection of new values.

For a more integrated solution, the electronic pressure switch 7 can further comprise an electrical connector 27 for connecting said electronic pressure switch 7 to an external power supply (not shown).

Because of this the electronic pressure switch 7 according to the present invention can be very easily integrated within existing systems.

The electronic pressure switch 7 can further comprise an analog to digital convertor 28 for the power circuit, such analog to digital convertor 28 being connected on the electric connection coming from the electrical connector 27.

In another preferred embodiment, the electronic pressure switch 7 can further keep track of the running hours and the real time hours. For facilitating such a feature, the the microprocessor unit 11 further comprises a first counter, T1, for measuring the running hours and a second counter, T2, for measuring the real time hours.

Preferably, said first counter, T1, is started when the manufacturing process of the compressor 1 is finished, and is preferably reset after a service procedure is finished, said first counter, T1, running continuously until the service procedure is completed.

Further preferably, said second counter, T2, is started when the compressor 1 is switched on for the first time after the manufacturing process is completed and is considering the amount of time when the compressor is functioning. Such a second counter, T2, can either be reset after the service procedure has ended or can continue to measure the time interval when the compressor is functioning.

Based on these counters: T1 and T2, a user of a compressor 1 can be informed when a specific service process needs to be performed. Preferably, the microprocessor unit 11 will generate an alarm signal 29 and make it visible on the screen 24.

The screen 24 can be further provided with a dedicated display 30 for showing the pressure value according to the measurement performed by said pressure sensor 9 or the current value according to the measurement performed by the current sensor 10.

In a preferred embodiment according to the present invention but not limiting thereto, the electronic pressure switch 7 comprises the following components or block of components within said housing 16: the pressure sensor 9, the current sensor 10, the first counter, T1, and/or the second counter, T2, the motor control, the motor starter, the screen 24, the control dial 25, one or more buttons such as the push button 26, the first alarm display 31 and/or the second alarm display 32 and/or the service alarm 29, a compressor control algorithm, a compressor protection algorithm, preset time intervals and warnings, the wireless communication interface 21.

The method for regulating the pressure within the compressor 1 is very simple and as follows.

The electronic pressure switch 7 according to the present invention needs to be connected on the compressed gas outlet 5, either on the outlet conduit of the compressor element 2 or at the vessel outlet 20. Further, the first communication unit 14 of the electronic pressure switch 7 needs to be connected with a drive of a motor 3 driving the compressor element 2.

The method according to the present invention further comprises the steps of measuring the pressure at the compressed gas outlet 5 and measuring the current of the motor 3. Based on the pressure and current measurement, the electronic pressure switch 7 is sending a signal to the microprocessor unit 11 for further processing.

If the received signal is not a digital signal, the microprocessor unit 11 is converting the signal into a pressure value and a current value respectively. The microprocessor unit further compares such values with an upper pressure limit and an upper current limit respectively, and if based on such comparison the received pressure value is higher than the upper pressure limit or if the received current value is higher than said upper current limit, the microprocessor unit 11 is generating an electronic signal for stopping the motor 3. Such electronic signal being sent through said first communication unit.

Due to its layout and capabilities the electronic pressure switch 7 according to the present invention provides a more reliable solution when compared to the mechanical actuated pressure switches and provides a much faster control.

Because electronic pressure switch 7 does not rely on mechanical components, the control performed can be more accurate and more parameters can potentially be taken into account, while the functioning of the compressor 1 can be assured by protecting its components.

Another advantage is that the control performed by said electronic pressure switch 7 can be easily adapted according to the requirements of the user's network 6.

Further, the screen 24 can be provided with a first alarm display 31 for informing the user when, based on the comparison, either the received pressure value is higher than the upper pressure limit or the received current value is higher than the upper current limit.

The screen 24 can also be provided with a second alarm display 32 informing the user when the compressor 1 is functioning and delivering compressed air to the user's network 6.

For providing a complete set of information to the user, the screen 24 can also be provided with a wireless display 33 informing the user if the wireless transceiver is switched on or not.

In an embodiment according to the present invention, depending on the user's network and the typical required response time for the compressor 1, the pressure and current measurements can be performed at a certain time interval or such measurements can be performed in real time.

The time interval at which the measurements are being performed preferably being selectable by the user. It is also possible for such time interval to be defined through design.

In yet another embodiment according to the present invention, said upper pressure limit and said upper current limit can be set by design or can be selected by the user according to his requirements.

If these limits are being set or selected by design, they can be selected as for example: the safe upper pressure value at which the compressor element 2 can function and/or the safe upper value of the current at which the motor 3 can function.

Another step of the method according to the present invention is to connect the second communication unit 15 of the pressure switch 7 with the blow-off valve 8 provided at the compressed gas outlet 5.

In the context of the present invention, said first communication unit 14 and said second communication unit should be understood as a wired or wireless medium conferring an electronic communication path between two components of the compressor 1.

As an example, the first communication unit 14 and the second communication unit 15, each can comprise: an electric wire having two connectors at each end, or a printed electrical connection on the PCB (Printed Circuit Board), or an electric wire having a transmitter at one end and a receiver at the other end, or in the case of a wireless medium, having a wireless card at each end capable of emitting and/or receiving a wireless signal.

The microprocessor unit 11 is preferably sending an electrical signal to a valve driver circuit 34 and through the second communication unit 15 for opening or closing the blow-off valve 8.

Such valve driver circuit 34 converting the command received from the microprocessor unit 11 into an electrical signal recognized by the blow-off valve 8.

In the context of the present invention the valve driver circuit 34 should be seen as a component capable of adapting the signal received from a low power circuit comprising the microprocessor 11 to a high power circuit comprising the blow-off valve 8.

Further, it should not be excluded that the current sensor 10 and the valve driver circuit 34 can be realized as one module.

Furthermore, it should not be excluded that the current sensor 10, the relay driver circuit 17, the electric relay 18 and the valve driver circuit 34 can be realized as one module.

Preferably but not limiting thereto, all the components part of the electronic pressure switch 7 are incorporated within a single electronic assembly whereby the communication between the different components or block of components is done at the level of one or more PCBs, or the connections towards such components are integrated within said one or more PCBs.

Even more preferably, all the components shown in FIG. 3 except the electrical connector 27, the motor 3, the blow-off valve 8, the screen 24, the compressed gas outlet 5 and evidently the housing 16 are comprised within a single PCB.

In another embodiment according to the present invention, said control dial 25 and said push button 26 can comprise electrical connections directly on a PCB and therefore be directly mounted on said PCB.

Preferably, if after the comparison the microprocessor unit 11 is generating a signal for stopping the motor 3, the microprocessor unit 11 is further generating an electrical signal controlling the blow-off valve 8, opening said blow-off valve 8.

In this manner, the compressor element 2 is prepared for a restart of the motor 3 and the user of the compressor 1 experiences a very short response time.

It goes without saying that the microprocessor unit 11 generates an electrical signal for starting the motor 3 when, based on the comparison, the received pressure measurement or the received current measurement is below the upper pressure limit or the upper current limit respectively.

Preferably, the microprocessor unit 11 is generating the electrical signal for starting the motor 3 when, after the comparison, the received pressure measurement and the received current measurement are below the upper pressure limit and the upper current limit respectively.

If the motor 3 is stopped, the microprocessor unit 11 is preferably informing the user by generating an alert signal on the screen 24 though said user interface 23.

By alerting the user, the microprocessor unit 11 is in fact allowing the user to identify any possible faults with the electrical circuit on the premises and also allows him to adapt and optimize the functioning of the compressor 1 according to his need.

For facilitating an easy communication with the user, the microprocessor unit 11 is sending and receiving commands through the wireless transceiver part of the wireless communication interface 21 of the electronic pressure switch 7.

In an embodiment according to the present invention said microprocessor unit 11 comprises a storing module 35 such as for example a local hard drive wherein the measurements for the pressure and the current are stored.

Whenever the user is realizing a communication path with the wireless transceiver, the microprocessor unit 11 is preferably sending the measurements for the pressure and the current stored since the previous interrogation. Afterwards, the microprocessor unit 11 can either discard such measurements or transfer them to an external hard drive or the cloud.

In yet another embodiment according to the present invention, the microprocessor unit 11 is analyzing the patterns of the user network 6 based on the measured pressure and current within a certain time interval. Accordingly, the microprocessor unit 11 is adapting the starting and stopping of the motor 3 not only based on the upper pressure limit and/or upper current limit, but also according to previous functioning patterns of usage of the compressor 1.

Accordingly, if the pressure value at the vessel outlet 20 is for example decreasing rapidly, the microprocessor unit 11 can restart the motor 3 sooner and not wait until the measured pressure drops below the upper pressure limit.

Another example is when the demand at the user's network 6 is high, the microprocessor unit 11 can allow the motor 3 to run for a longer period of time and not stop the motor immediately after the measured pressure is equal to or higher than the upper pressure limit or immediately when the measured current is equal to or higher than the upper current limit.

Preferably but not limiting thereto, the microprocessor unit can further compare the value based on the pressure measurement with an upper critical pressure limit and if the value is equal to or higher than said upper critical pressure limit, the microprocessor unit 11 generates an electric signal for stopping the motor 3. Said upper critical pressure limit typically being higher than the upper pressure limit.

Further, the microprocessor unit can also compare the value based on the current measurement with an upper critical current limit and if the value is equal to or higher than said upper critical current limit, the microprocessor unit 11 generates an electric signal for stopping the motor 3. Said upper critical current limit typically being higher than the upper current limit.

As an example only, and without limiting thereto, the pressure switch according to the present invention can be included in compressors 1 having a working pressure range selected typically between approximately zero to forty bar, and a working power selected typically between approximately one to ten kilowatt.

The present invention is also suitable to be implemented within an expander or a vacuum pump.

If the system comprises an expander, the layout of the expander would be like the one illustrated in FIG. 1 or 2, the only difference would be that instead of a compressor element 2, the system would comprise an expander element.

Figure 5:
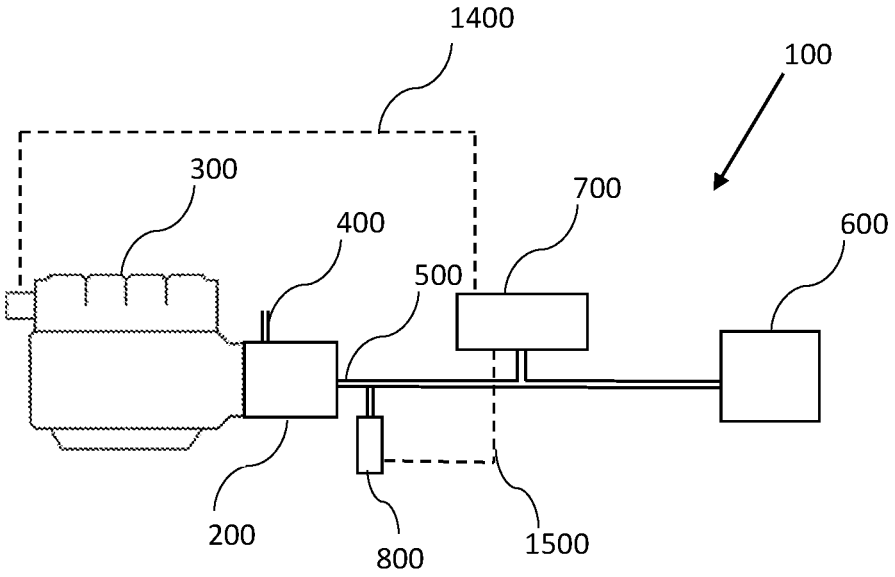
FIG. 5 schematically represents a vacuum pump system according to an embodiment of the present invention.

As can be seen in FIG. 5, if the system comprises a vacuum element 200, the layout of the vacuum pump 100 would be like the one illustrated in FIG. 1, including motor 300, compressed gas outlet 500, user network 600, pressure switch 700, blow-off valve 800, communication unit 1400, and second communication unit 1500. The differences would be the fact the process gas inlet 4 shown in FIG. 1 would be the gas outlet 400 for the vacuum element 200, the process gas outlet 5 would be equivalent to a process gas inlet 500 of the vacuum element 200, and in that the electronic pressure switch 7 would be connected on the pressure gas inlet 200 of said vacuum element 200.

Figure 6:
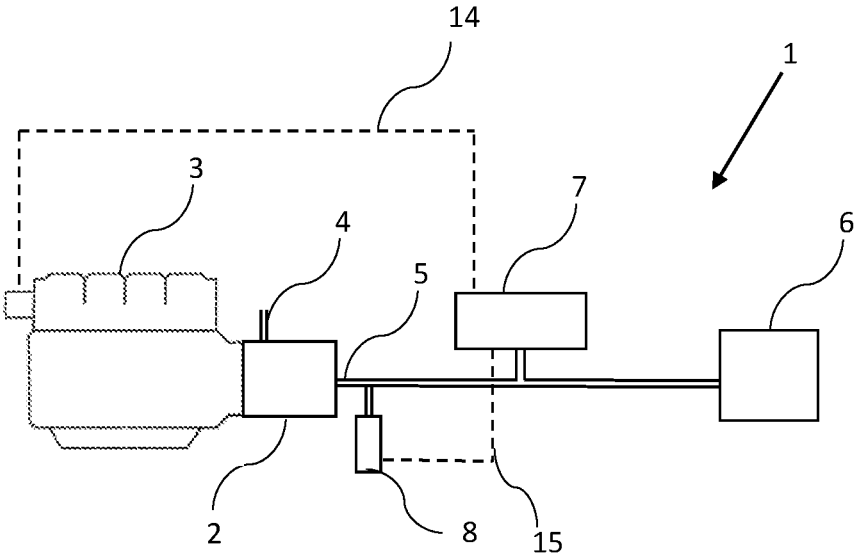
FIGS. 6 and 7 schematically represent a compressor system according to an embodiment of the present invention.
Figure 7:
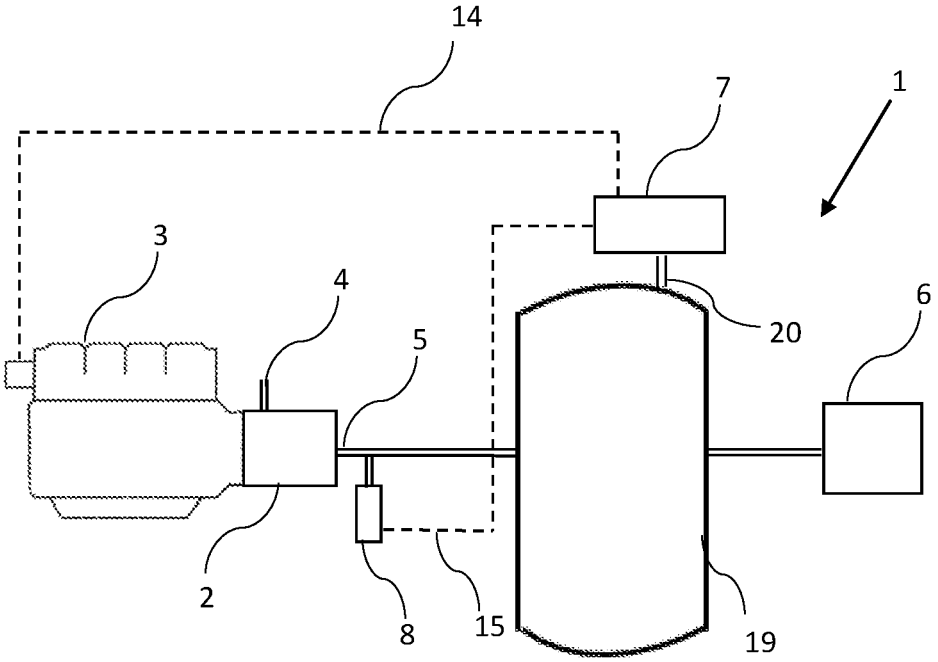

While FIGS. 1 and 2 are showing a piston compressor element 2, the present invention should not be limited to such a type of compressor element 2. FIGS. 6 and 7 show another example wherein the compressor element 2 is of a screw type.

It should be understood that the pressure switch 7 according to the present invention can be used with any type of compressor element 2 and the present invention should not be limited to the provided examples.

In the context of the present invention it should be understood that the different features as defined within the present paper can be used in any combination without departing from the scope of the invention.

The present invention is by no means limited to the embodiments described as an example and shown in the drawings, but such a gas filter 1 can be realized in all kinds of variants, without departing from the scope of the invention.

The invention claimed is:

1. A gas compressor comprising a gas compressor element, a motor configured to drive said gas compressor element and an electronic pressure switch, said electronic pressure switch comprising:

a pressure sensor for sensing pressure signals at a compressed gas outlet of the gas compressor;

a current sensor for sensing current signals of the motor driving the gas compressor element;

a microprocessor unit comprising a first input port connected to said pressure sensor for receiving the pressure signals and a second input port connected to said current sensor for receiving the current signals;

a first communication unit for connecting the electronic pressure switch with a drive of the motor;

a second communication unit for connecting the electronic pressure switch with a blow-off valve provided at the compressed gas outlet; and wherein the electronic pressure switch further comprises a housing, wherein the microprocessor unit, the pressure sensor, the current sensor, the first communication unit and the second communication unit are integrated in said housing, wherein the microprocessor unit is configured to convert the pressure signals into present pressure values and the current signals into present current values, to compare the present pressure values to an upper pressure limit and the present current values to an upper current limit, wherein the microprocessor unit further comprises a storing module configured to store the present pressure values and present current values acquired during a present interrogation and at least one previous interrogation, and the microprocessor unit is configured to further take into account changes in the stored pressure and current values over a time interval between the at least one previous interrogation and the present interrogation in determining when to restart the motor or stop the motor; wherein:

the microprocessor is configured to start the motor via the first communication unit at a time when one of the present pressure values is below the upper pressure limit and when one of the present current values is below the upper current limit, and to start the motor sooner than said time based on changes in the stored pressure values, when said one of the present pressure values is higher than the upper pressure limit, the microprocessor is configured to stop the motor via the first communication unit, and to delay said stop based on the changes in the stored pressure or current values, and when said one of the present current values is higher than the upper current limit, the microprocessor is also configured to stop the motor via the first communication unit, and to delay said stop based on changes in the stored pressure or current values.

2. The gas compressor according to claim 1, wherein the gas compressor further comprises a pressure vessel and in that the electronic pressure switch is adapted to be provided on a vessel outlet of said pressure vessel.

3. The gas compressor according to claim 1, wherein the electronic pressure switch further comprises a wireless communication interface further comprising a wireless transceiver selected from a group comprising: a Bluetooth, an RF, Wi-Fi and Infrared.

4. The gas compressor according to claim 3, wherein said microprocessor unit comprises a third input port connected to said wireless transceiver.

5. The gas compressor according to claim 1, wherein the pressure sensor is an air pressure transducer.

6. The gas compressor according to claim 1, further comprising a user interface comprising a screen.

7. The gas compressor according to claim 1, wherein the electronic pressure switch further comprises an electrical connector for connecting said electronic pressure switch to an external power supply.

8. The gas compressor according to claim 1, wherein the microprocessor unit further comprises a first counter for measuring running hours of the gas compressor and a second counter for measuring real time hours of the gas compressor, wherein the first counter is started after completion of a manufacturing of the gas compressor, and the second counter is started when the gas compressor is first started.

9. The gas compressor according to claim 1, wherein the microprocessor unit, the pressure sensor, the current sensor, the first communication unit and the second communication unit are all integrated on a single printed circuit board.

10. The gas compressor according to claim 1, wherein when one of the present pressure values is higher than an upper critical pressure limit or if one of the present current values is higher than an upper critical current limit, the microprocessor is configured to stop the motor via the first communication unit, wherein the upper critical pressure limit is higher than the upper pressure limit and the upper critical current limit is higher than the upper current limit.

11. The gas compressor according to claim 1, wherein said gas is air.

12. The gas compressor according to claim 1, configured to allow a user to extract or create graphs with a functioning pattern of the compressor.

13. The gas compressor according to claim 1, wherein the microprocessor unit is configured to restart the motor if a difference between said one of the present pressure values and one of the stored pressure values exceeds a predetermined threshold, and to not wait until said one of the present pressure values drops below the upper pressure limit.

14. The gas compressor according to claim 1, wherein the microprocessor unit is configured to not stop the motor immediately after the present one of the pressure values is equal to or higher than the upper pressure limit or when the present one of the current values is equal to or higher than the upper current limit.

* * * * *